US008905898B2

(12) United States Patent
Chen

(10) Patent No.: US 8,905,898 B2
(45) **Date of Patent: *Dec. 9, 2014**

(54) TRAMPOLINE ENCLOSURE NET

(71) Applicant: Samuel Chen, Shanghai (CN)

(72) Inventor: Samuel Chen, Shanghai (CN)

( * ) Notice: Subject to any disclaimer, the term of this patent is extended or adjusted under 35 U.S.C. 154(b) by 0 days.

This patent is subject to a terminal disclaimer.

(21) Appl. No.: 14/244,656

(22) Filed: Apr. 3, 2014

(65) Prior Publication Data

US 2014/0221162 A1 Aug. 7, 2014

Related U.S. Application Data

(63) Continuation-in-part of application No. 13/416,977, filed on Mar. 9, 2012, now Pat. No. 8,764,610.

(51) Int. Cl.

| | |
|---|---|
| ***A63B 21/00*** | (2006.01) |
| ***A63B 71/00*** | (2006.01) |
| ***A63B 5/11*** | (2006.01) |
| ***A63B 43/00*** | (2006.01) |
| *A63B 71/02* | (2006.01) |

(52) U.S. Cl.

CPC ..... *A63B 71/0054* (2013.01); *A63B 5/11* (2013.01); *A63B 43/005* (2013.01); *A63B 71/022* (2013.01)

USPC ..... 482/27; 482/28

(58) Field of Classification Search

USPC ..... 482/27, 28

See application file for complete search history.

(56) References Cited

U.S. PATENT DOCUMENTS

| | | | | |
|---|---|---|---|---|
| 7,611,443 | B2 * | 11/2009 | Publicover | 482/27 |
| 7,850,575 | B1 * | 12/2010 | Hsiang | 482/27 |
| 2006/0058157 | A1 * | 3/2006 | Greiner et al. | 482/27 |
| 2013/0109639 | A1 * | 5/2013 | Hughes et al. | 514/26 |

* cited by examiner

*Primary Examiner* — Jerome W Donnelly
(74) *Attorney, Agent, or Firm* — Clement Cheng

(57) ABSTRACT

A trampoline includes a trampoline bed secured to a frame. The trampoline bed is made of trampoline bed material. An enclosure includes an enclosure net made of enclosure net material, a net hem formed on the enclosure net, a plurality of net hem openings formed on the net hem, and a bed hem attached to a periphery of the trampoline bed. The bed hem is made of enclosure net material. A plurality of bed hem openings are formed on the bed hem. A securing cord is sized to weave the plurality of net hem openings to the plurality of bed hem openings.

12 Claims, 7 Drawing Sheets

TRAMPOLINE ENCLOSURE NET

This application is a continuation in part of parent application to same inventor Chen, et. al. entitled Trampoline Equipped With a Protective Circular Net having Ser. No. 13/416,977 filed Mar. 9, 2012 and which was published as United States patent publication 2013/0005537 on Jan. 3, 2013.

FIELD OF THE INVENTION

The present invention is in the field of trampoline enclosure netting.

DISCUSSION OF RELATED ART

A trampoline having an enclosure typically has an enclosure that is connected to the frame. A net is typically connected to the enclosure. For example, as seen in U.S. Pat. No. 8,585,558, issued Nov. 19, 2013 to Samuel Chen, the disclosure of which is incorporated herein by reference, the trampoline has a netting that encloses a user to prevent a user from falling out. Publicover provides a trampoline having a safety net in U.S. Pat. No. 7,794,360 entitled Trampoline And The Like With Enclosure issued Sep. 14, 2010, the disclosure of which is incorporated herein by reference.

SUMMARY OF THE INVENTION

A trampoline includes a trampoline bed secured to a frame. The trampoline bed is made of trampoline bed material. An enclosure includes an enclosure net made of enclosure net material, a net hem formed on the enclosure net, a plurality of net hem openings formed on the net hem, and a bed hem attached to a periphery of the trampoline bed. The bed hem is made of enclosure net material. A plurality of bed hem openings are formed on the bed hem. A securing cord is sized to weave the plurality of net hem openings to the plurality of bed hem openings.

Optionally, the adapter member has an annular shape. Preferably, the enclosure netting has a lower density than the trampoline bed fabric. The enclosure netting has small apertures. The plurality of bed hem openings are distal to a spring loop sleeve that holds spring loops made of a triangular shape with a pointed tip facing the frame. The spring loop sleeve is made of a resilient fabric. The enclosure net is suspended from a ring that is held by enclosure poles. The enclosure net has a net main body. The net hem also may have a net hem upper stitching and a net hem lower stitching.

Additionally, United States patent publication 2013/0005537 published Jan. 3, 2013, to same inventor Chen entitled Trampoline Equipped With a Protective Circular Net provides an attachment from the net to the bed, the disclosure of which is incorporated herein by reference.

Figure 1:
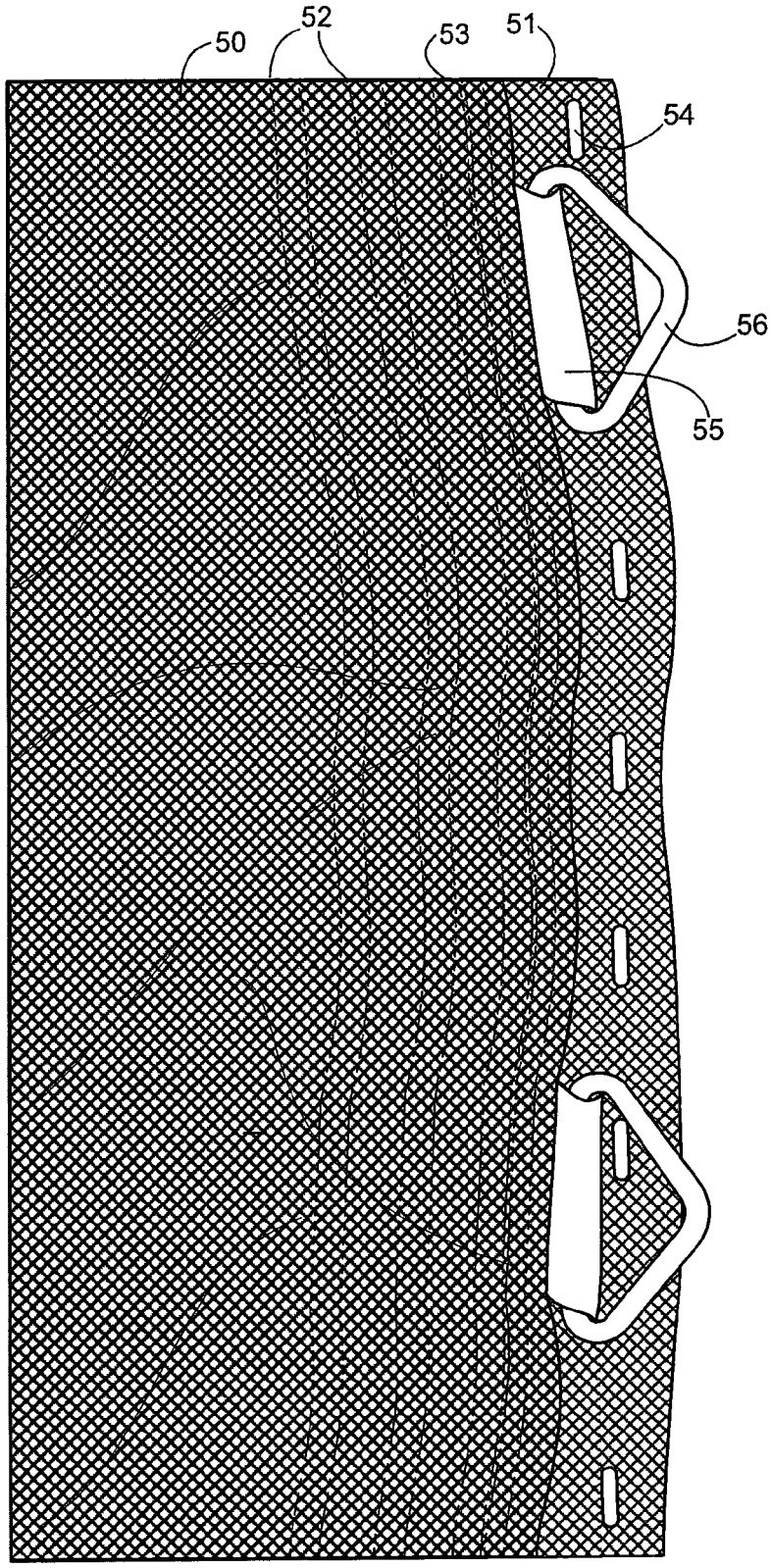
FIG. 1 is a top close-up view of an external peripheral of a trampoline bed.
Figure 2:
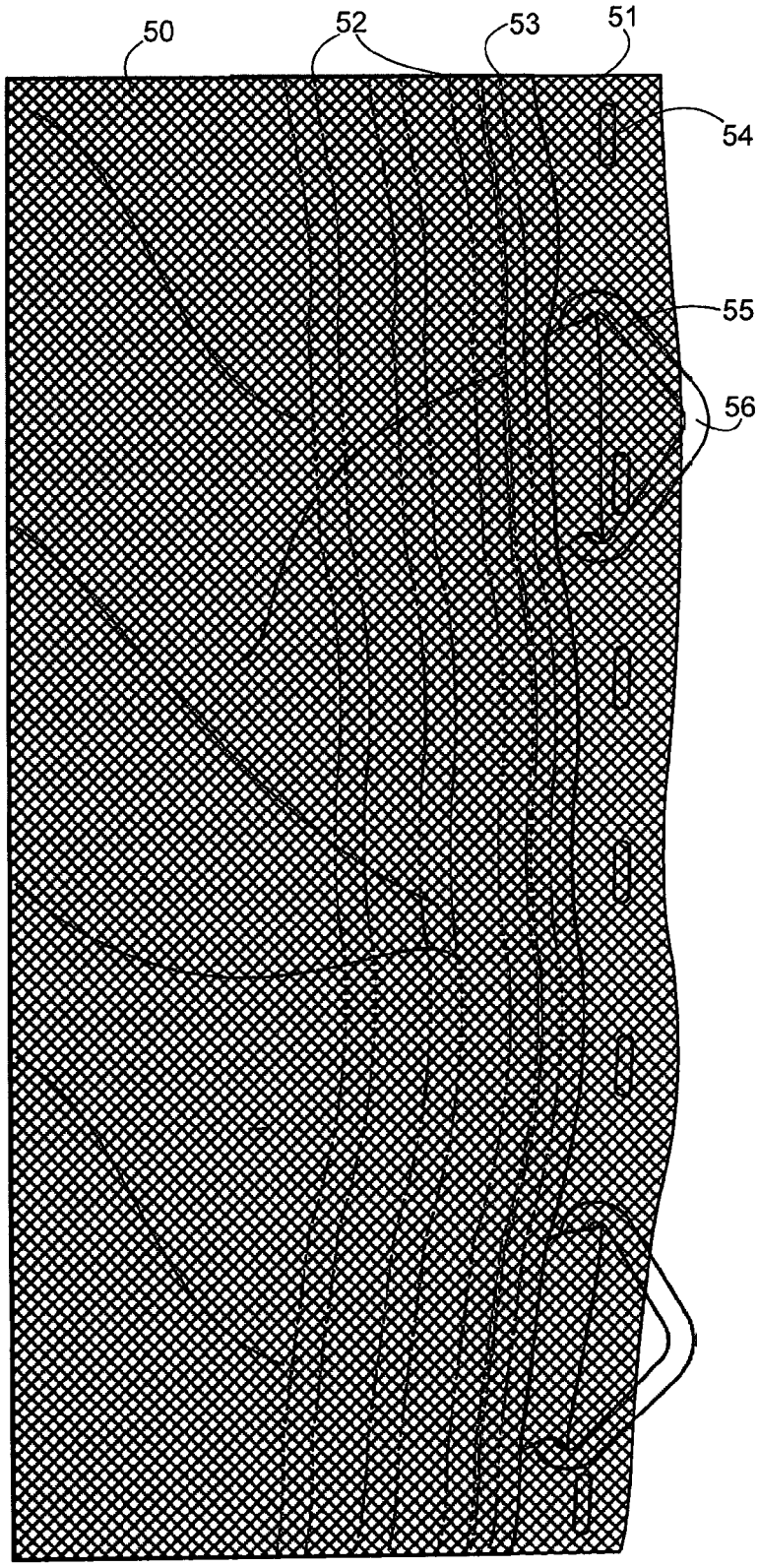
FIG. 2 is a bottom close-up view of an external periphery of a trampoline bed.
Figure 3:
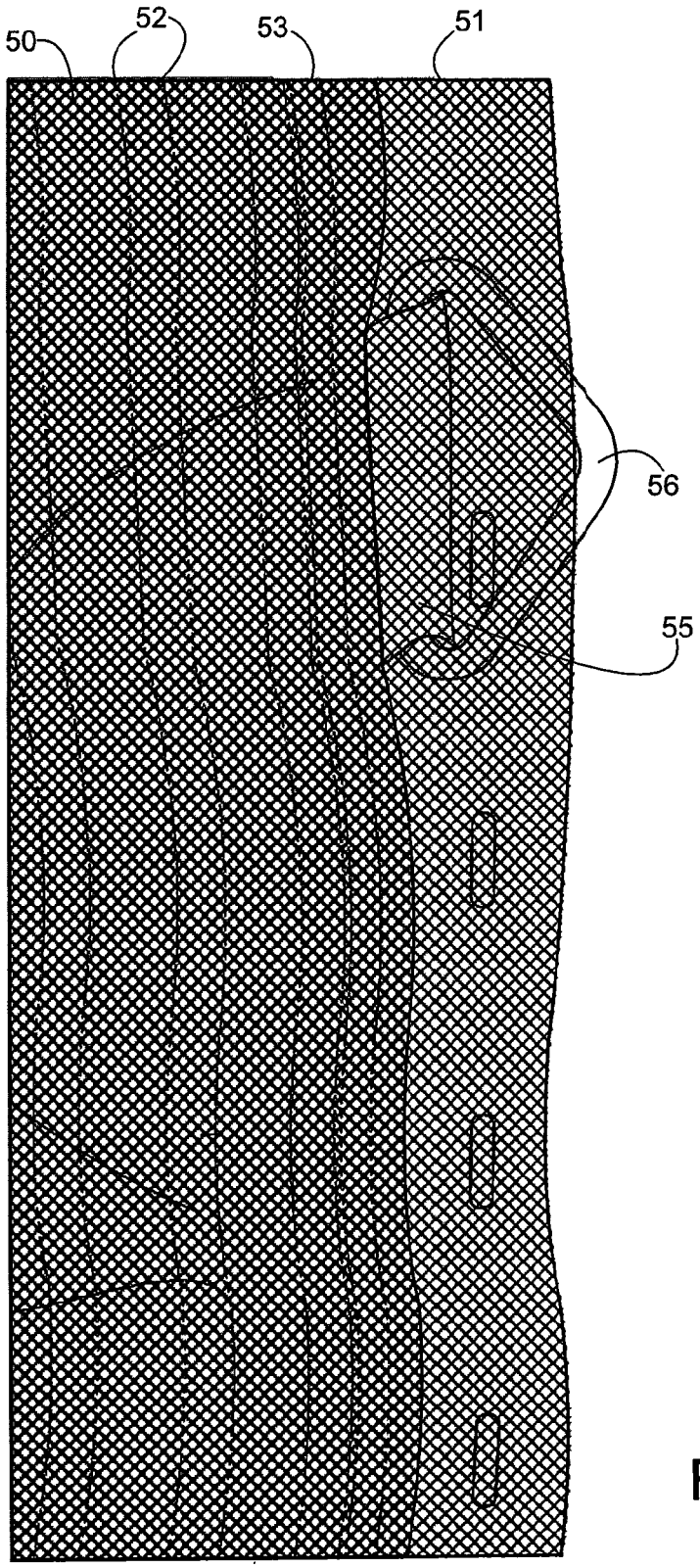
FIG. 3 is a bottom zoom view of an external periphery of the trampoline bed.
Figure 4:
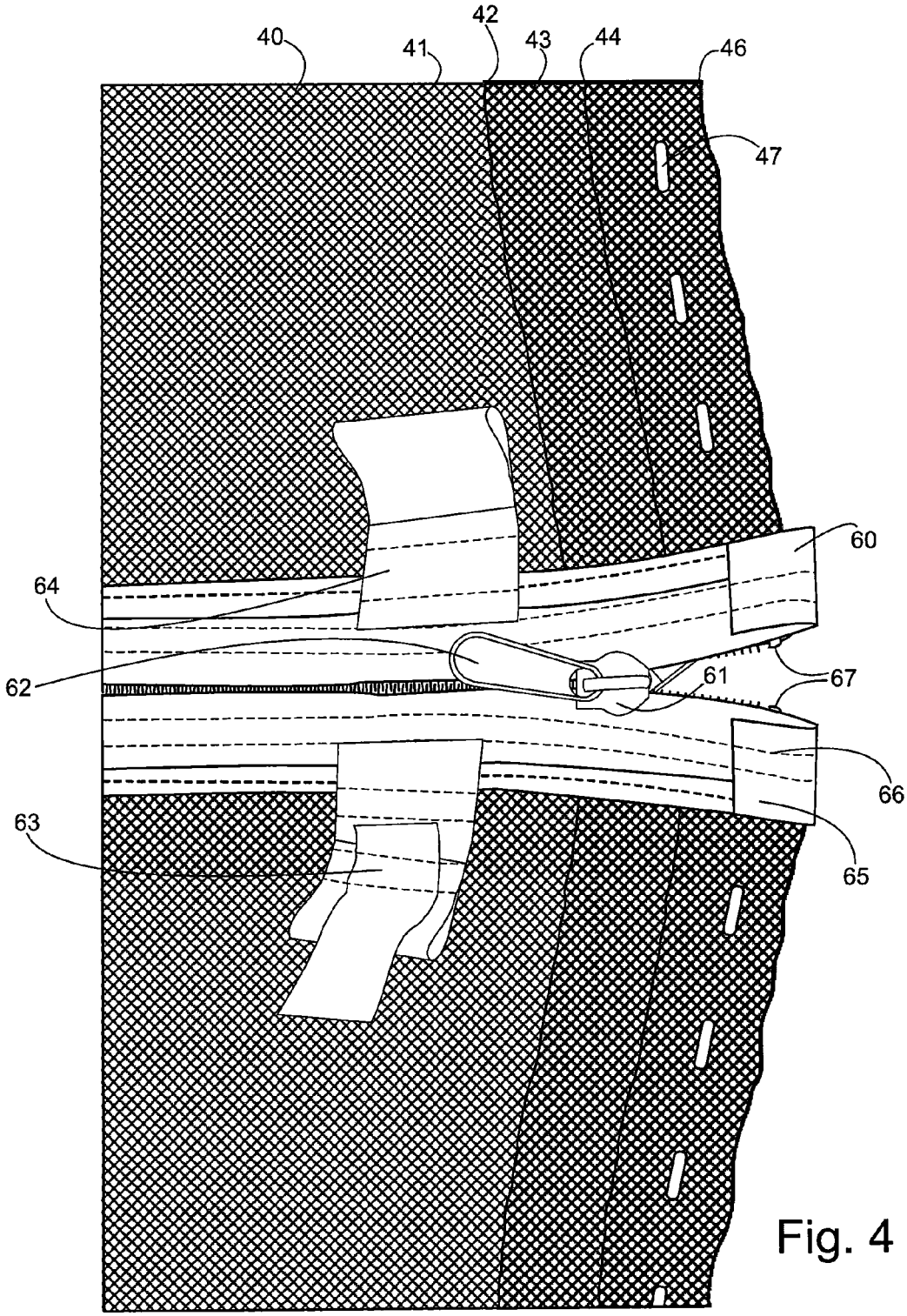
FIG. 4 is an inside close-up view of the zipper assembly.
Figure 5:
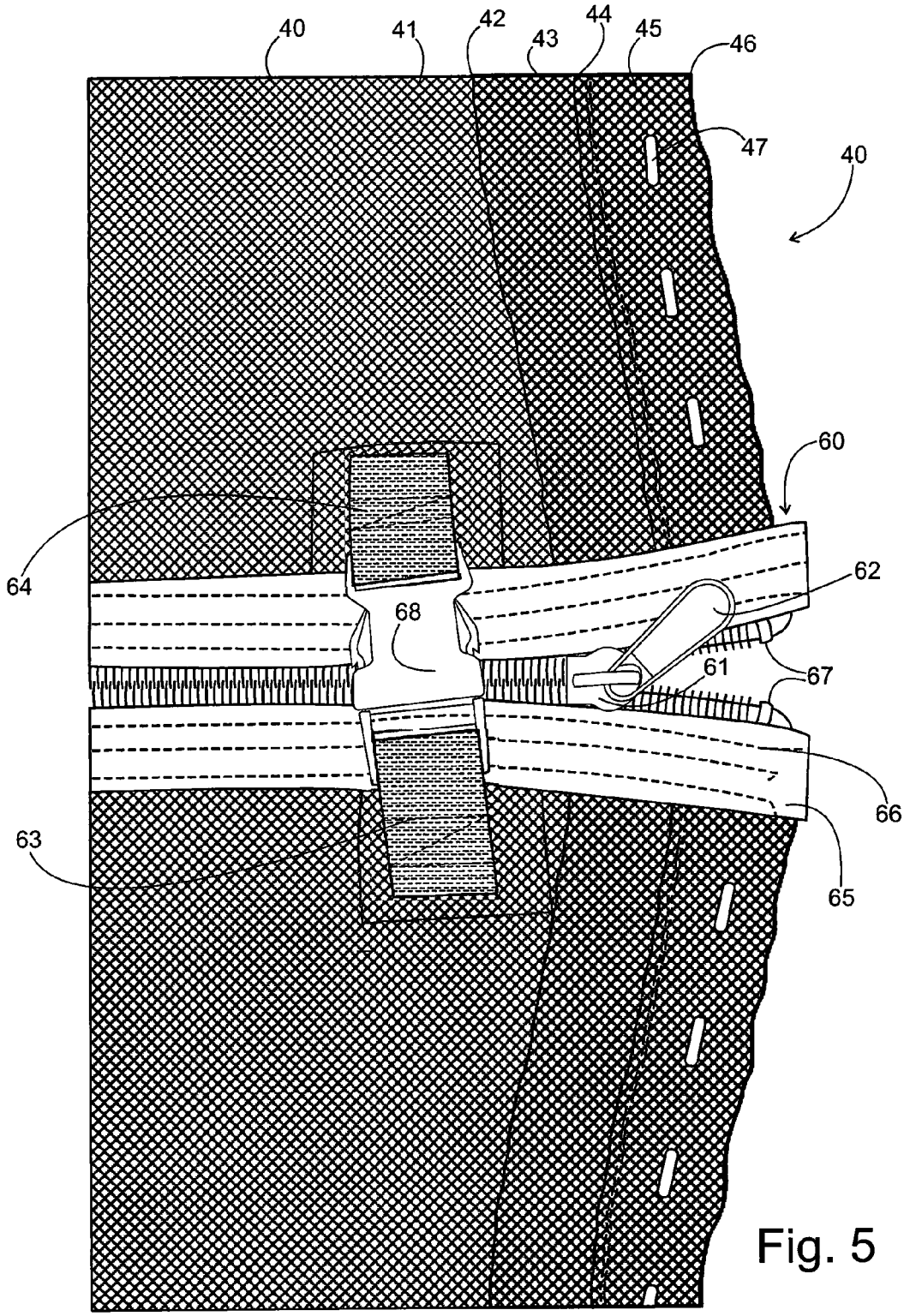
FIG. 5 is an outside close-up view of the zipper assembly.
Figure 6:
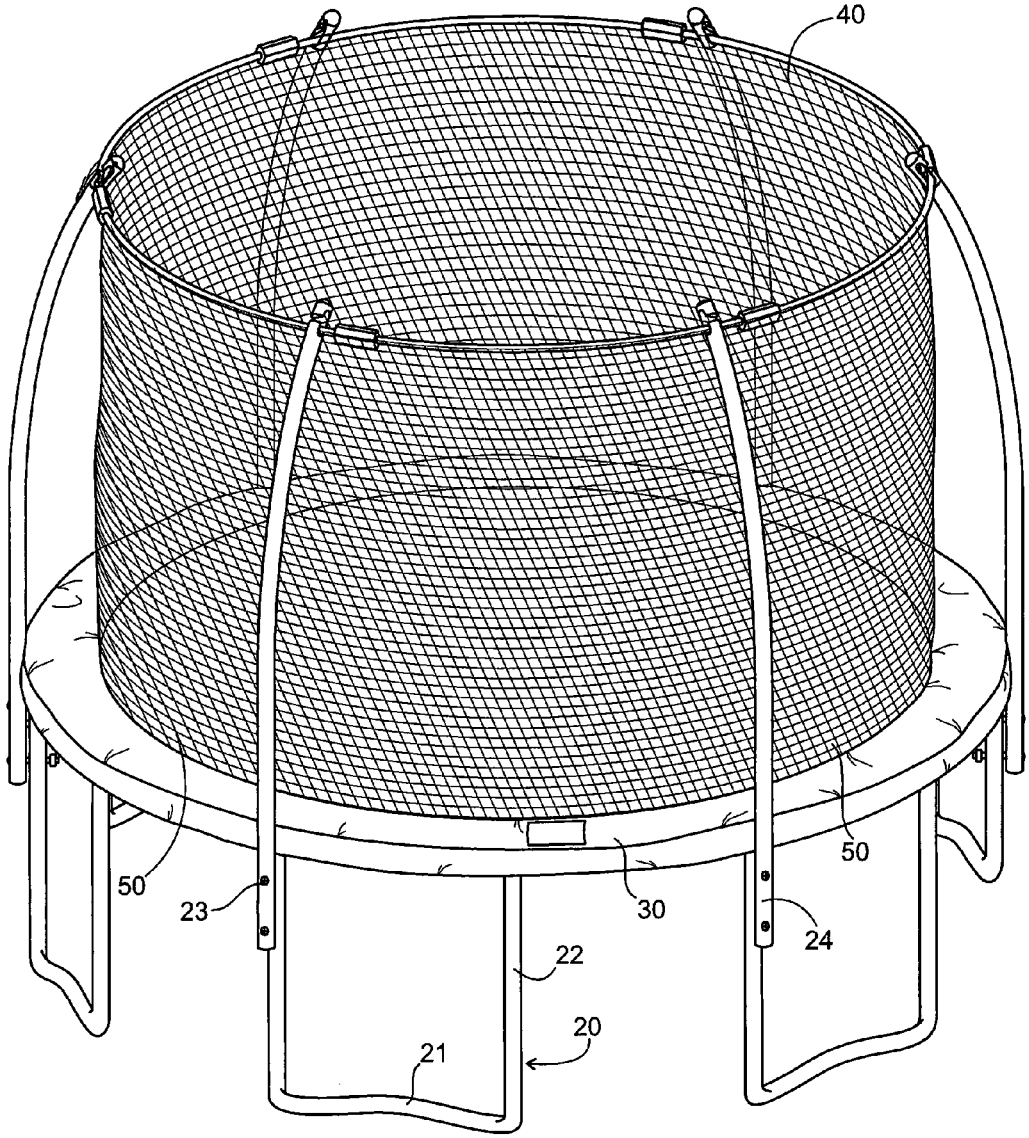
FIG. 6 is a perspective view of the trampoline.
Figure 7:
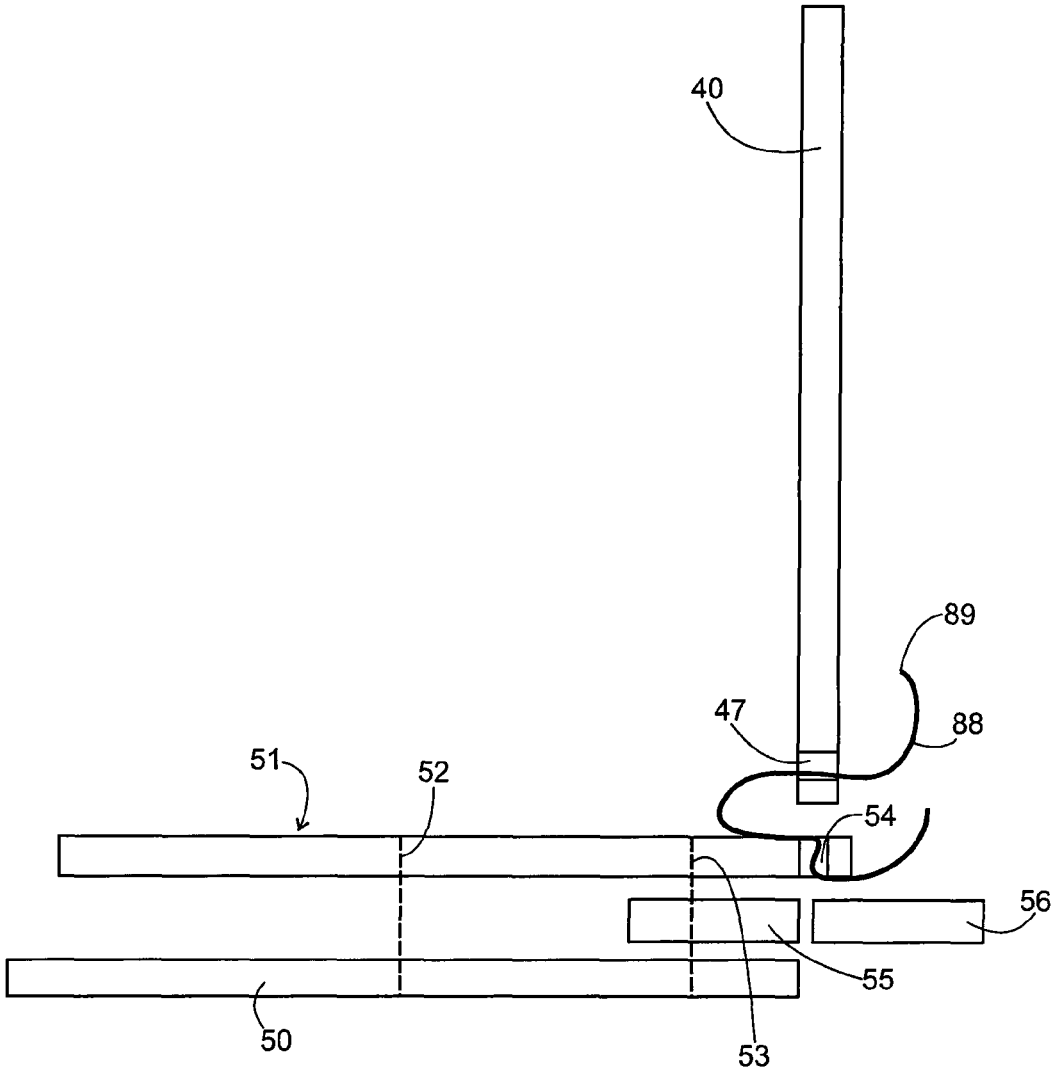
FIG. 7 is a diagram of the trampoline netting to bed connection.

The following call out list of elements can be a useful guide in referencing the elements of the drawings.

20 Leg
21 Footing
22 Leg Vertical Member
23 Bolt Connector
24 Enclosure Pole
30 Pad
40 Enclosure Net
41 Net Main Body
42 Net Hem Upper Stitching
43 Net Inside Hem
44 Net Hem Lower Stitching
45 Net Hem
46 Net Hem Edge
47 Net Hem Opening
50 Trampoline Bed
51 Bed Hem
52 Hem Inside Stitching
53 Bed Hem Outside Stitching
54 Bed Hem Opening
55 Spring Loop Sleeve
56 Spring Loop
60 Zipper Panel
61 Zipper Body
62 Zipper Pull
63 First Strap
64 Second Strap
65 Zipper Panel Hem
66 Zipper Panel Stitch
67 Zipper Stop
68 Buckle
88 Securing Cord
89 Cord Tip

DETAILED DESCRIPTION OF THE PREFERRED EMBODIMENT

The trampoline generally has trampoline bed 50 suspended across the frame. The frame typically includes several legs 20 that each have a footing 21. Also, a pad 30 fits around the trampoline bed 50. The frame is connected to enclosure poles 24 that suspend a net 40 from the trampoline bed 50. The enclosure poles can be bolted to the leg 20 by bolt connectors 23. A pair of bolt connectors can rigidly attach the lower end of the enclosure pole 22 the upper end of the leg 20. The footing 21 can be formed by bending a length of steel tube to form a pair of upwardly bent legs with a middle portion of the steel tube forming the footing. The footing 21 is typically socketed to the portion of the frame that supports the trampoline bed 50. The trampoline bed 50 is typically suspended across the frame by several dozen helical springs, but new alternatives such as elastic cord, torsion springs and rods can also be used.

The trampoline bed 50 makes a connection to the enclosure net 40 at a lower periphery of the enclosure net and at an outside periphery of the trampoline bed. The trampoline bed 50 is made of a woven fabric that is cut to a template and edge finished by adding an adapter member which is a strip of enclosure netting that is connected to the trampoline bed at a periphery of the trampoline bed. The adapter member receives a bed hem 51 on the enclosure netting. Enclosure netting is a fabric mesh made looser and having a lower density than the trampoline bed fabric and having small apertures to provide visibility through the enclosure netting. The enclosure netting small apertures are small enough to avoid finger entrapment.

A hem is a fabric finishing method when the fabric edge is folded and sewn to prevent unraveling of the fabric. A hem stitch may be a plain hem that is folded once and sewn with a running stitch, or can be a more complicated stitch such as an overlock from a serger.

The trampoline bed 50 has a hem 51. The hem 51 is on the long strip of circumferential net material that has been sewn to the trampoline bed 50. The hem 51 has a plurality of bed hem openings 54 distal to the spring loop sleeve 55 that holds the spring loops 56. The spring loops 56 can be made of a triangular shape with a pointed tip facing the frame.

The spring loop sleeve 55 is a woven fabric that is stitched to the trampoline bed material and held by the bed hem inside stitching 52 and the bed hem outside stitching 53. The spring loop sleeve 55 is placed between the bed hem 51 made of enclosure net material and the trampoline bed 50 made of trampoline bed material. The bed hem inside stitching 52 preferably stitches through the bed hem 51 and the trampoline bed 50. The bed hem outside stitching 53 preferably stitches through the spring loop sleeve 55 to connect it to the hem 51 and the trampoline bed 50. The spring loop sleeve is made of a heavy fabric that is resilient and retains the spring loop 56 so that the spring loop can in turn connect to the spring.

The trampoline bed 50 also has trampoline bed material that has been folded and sewn to its edge to provide a hem on a bed hem inside stitching 52 and also on a bed hem outside stitching 53. The trampoline bed material is thus merged to the trampoline net material on the trampoline bed.

The enclosure net 40 is suspended from a ring that is held by enclosure poles. The enclosure net has a net main body 41. The net hem upper stitching 42 and the net hem lower stitching 44 form a net inside hem 43 and a net hem 45. The net hem 45 has a net hem edge 46. The net hem edge 46 has a number of net hem openings 47 spaced at regular intervals. The net hem openings 47 match with the bed hem openings 54 so that a securing cord 88 can interweave between the net hem openings 47 and the bed hem openings 54. The cord 88 has a cord tip 89 that allows a user to weave the cord 88 through the net hem openings 47 and the bed hem openings 54 to secure them together.

The zipper panel 60 is installed on the enclosure net 40 to allow entry and egress. The zipper panel 60 generally has a zipper body 61, and a zipper pull 62. The zipper panel hem 65 can extend from the net hem edge 46. The zipper panel 60 can be connected to the enclosure net 40 by a zipper panel stitching 66. The zipper panel 60 terminates at the zipper stopper 67.

The first strap 63 and second strap 64 reinforce the zipper at a left and right side of the zipper. The first strap 63 and second strap 64 can connect to each other at a buckle 68. The buckle 68 can be made of plastic and have a first section that connects to a second section. The buckle first section can connect to the first strap and the buckle second section can connect to the second strap.

The invention claimed is:

1. A trampoline comprising:

a. a trampoline bed secured to a frame, wherein the trampoline bed is made of trampoline bed material;

b. an enclosure including an enclosure net made of enclosure net material;

c. a net hem formed on the enclosure net;

d. a plurality of net hem openings formed on the net hem;

e. an adapter member made of enclosure net material and sewn around the periphery of the trampoline bed;

f. a bed hem formed on the adapter member and formed around a periphery of the trampoline bed, wherein the bed hem is made on enclosure net material;

g. a plurality of bed hem openings formed on the bed hem; and h. a securing cord, wherein the securing cord is sized to weave the plurality of net hem openings to the plurality of bed hem openings.

2. The trampoline of claim 1, wherein the adapter member has an annular shape.

3. The trampoline of claim 1, wherein the enclosure netting has a lower density than the trampoline bed fabric.

4. The trampoline of claim 1, wherein the enclosure netting has small apertures.

5. The trampoline of claim 1, wherein the plurality of bed hem openings are distal to a spring loop sleeve that holds spring loops made of a triangular shape with a pointed tip facing the frame.

6. The trampoline of claim 5, wherein the spring loop sleeve is made of a resilient fabric.

7. The trampoline of claim 1, wherein the enclosure net is suspended from a ring that is held by enclosure poles, wherein the enclosure net has a net main body, wherein the net hem further comprises a net hem upper stitching and a net hem lower stitching.

8. The trampoline of claim 7, wherein the adapter member has an annular shape.

9. The trampoline of claim 7, wherein the enclosure netting has a lower density than the trampoline bed fabric.

10. The trampoline of claim 7, wherein the enclosure netting has small apertures.

11. The trampoline of claim 7, wherein the plurality of bed hem openings are distal to a spring loop sleeve that holds spring loops made of a triangular shape with a pointed tip facing the frame.

12. The trampoline of claim 11, wherein the spring loop sleeve is made of a resilient fabric.

* * * * *